United States Patent [19]

Parker

[11] 4,277,955

[45] Jul. 14, 1981

[54] TWIN COMPRESSOR MECHANISM IN ONE ENCLOSURE

[75] Inventor: Sidney A. Parker, Ft. Worth, Tex.

[73] Assignee: Lennox Industries, Inc., Ft. Worth, Tex.

[21] Appl. No.: 75,251

[22] Filed: Sep. 13, 1979

[51] Int. Cl.[3] ..... F25B 1/10

[52] U.S. Cl. ..... 62/510; 417/426; 417/902

[58] Field of Search ..... 62/510; 417/426, 427, 417/428, 415, 419, 902

[56] References Cited

U.S. PATENT DOCUMENTS

| | | | |
|---|---|---|---|
| 3,039,676 | 6/1962 | Mikina | 417/902 |
| 3,126,713 | 3/1964 | Parker | 62/117 |
| 3,162,360 | 12/1964 | Privon et al. | 417/902 |
| 3,315,880 | 4/1967 | Kropiwnicki | 417/902 |
| 3,386,262 | 6/1968 | Hackbart et al. | 62/510 |
| 3,503,223 | 3/1970 | Parker | 62/510 |
| 4,105,374 | 8/1978 | Scharf | 417/426 |
| 4,108,581 | 8/1978 | Miller et al. | 417/902 |
| 4,205,537 | 6/1980 | Dubberley | 62/510 |

*Primary Examiner*—Ronald C. Capossela

*Attorney, Agent, or Firm*—Allegretti, Newitt, Witcoff & McAndrews, Ltd.

[57] ABSTRACT

A hermetic refrigerant compressor assembly comprising an outer housing with at least two separate compressors within said outer housing, each compressor including a compression mechanism driven by an electric motor. If desired, the compressors may each be of different capacity so as to selectively vary the capacity of the system, dependent upon which compressor is operating. The individual compressors may each be two stage compressors, whereby four stages of capacity is easily provided for. The compressor assembly having two separate compressors within an outer housing is relatively low cost as compared to a single large sized hermetic compressor and is very versatile in operation.

The control means for controlling the operation of the separate compressors include means within the outer casing for preventing flow of discharge gas from the compression mechanism on one compressor to the compression mechanism of the second compressor when said second compressor is inoperative. Preferably, the control means are disposed within a discharge gas muffler.

11 Claims, 7 Drawing Figures

TWIN COMPRESSOR MECHANISM IN ONE ENCLOSURE

BACKGROUND AND SUMMARY OF THE INVENTION

This invention relates to a hermetic refrigerant compressor assembly and more particularly, to a hermetic refrigerant compressor assembly having two separate compressors, each comprising a compression mechanism and a drive motor within a single outer casing.

Larger size refrigerant compressors, for example, ten ton or more capacities, are made in smaller quantities and hence, are relatively expensive as compared to smaller compressors, for example, three to five ton capacities, which are fabricated in much greater number by mass production techniques. Capacity modulation as applied to larger sized refrigerant compressors is often inefficient. Relatively recently, two speed refrigerant compressors have been designed which effectuate capacity modulation by operating at high speed or low speed to provide full capacity and one half capacity. The two stage refrigerant compressor sacrifices efficiency as compared to a single stage motor with optimum design. Design compromises are required to maximize efficienceis of the two and four pole motor windings. The two stage compressor is relatively expensive, particularly in large size devices.

An object of the present invention is to provide an improved hermetic refrigerant compressor assembly having two compression mechanisms and associated motors within a single outer casing.

Another object of this invention is to provide an improved refrigerant compressor assembly having at least two compression mechanisms, each driven by single stage motor, disposed within a common outer casing, such refrigerant compressor being versatile and relatively less costly than a compressor comprising a larger compression mechanism and motor within a casing.

Yet another object of this invention is to provide an improved hermetic refrigerant compressor assembly comprised of a pair of like compressors (compression mechanism and motor) that are made in high volume and at relatively low cost, said compressors being disposed in a common outer casing.

A further object of this invention is to provide an improved hermetic refrigerant compressor assembly comprised of at least a pair of like compressors in a single outer casing, each compressor including a compression mechanism and an associated drive motor with means within the outer casing for preventing flow of discharge gas from one compression mechanism to the other compression mechanism when said other compression mechanism is inoperative. These and other objects of the present invention will become more apparent hereinafter.

BRIEF DESCRIPTION OF THE DRAWING

There is shown in the attached drawing presently preferred embodiments of the present invention, wherein like numerals refer to like elements in the various views and wherein.

DETAILED DESCRIPTION OF THE PRESENT INVENTION

Figure 1:
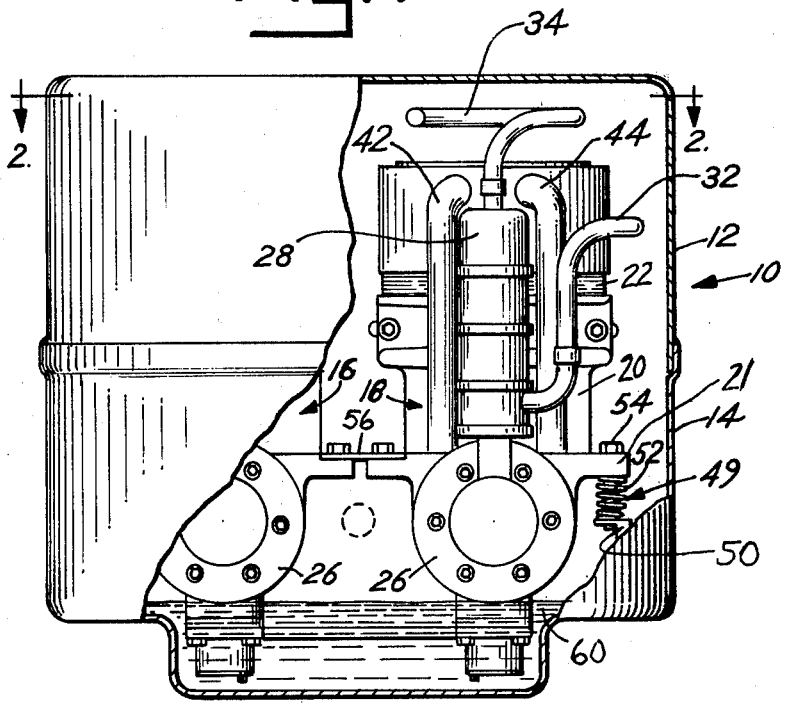
FIG. 1 is a side elevation view of an improved compressor assembly embodying the present invention, with parts broken away to better show the internal construction.
Figure 2:
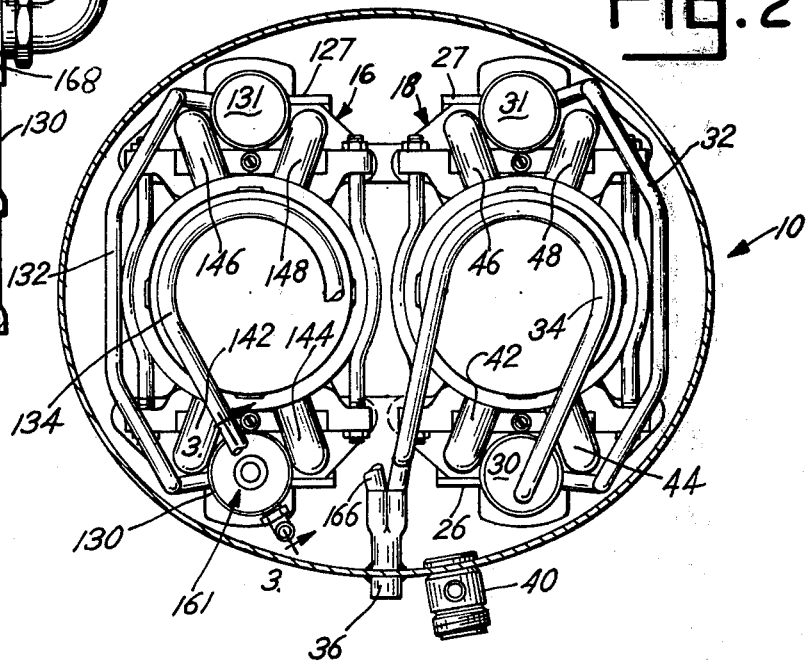
FIG. 2 is a cross-sectional view of the compressor assembly of the present invention taken generally along the line 2—2 of FIG. 1.
Figure 4:
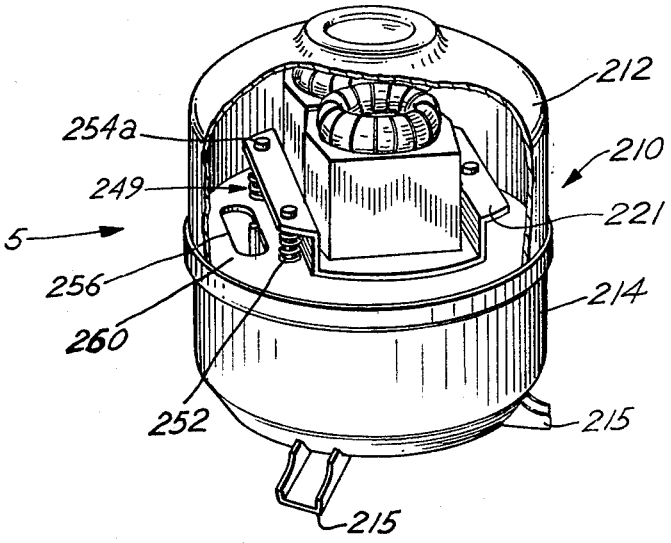
FIG. 4 is a perspective view of a modified compressor assembly, with part of the outer housing broken away to better show the internal construction.
Figure 5:
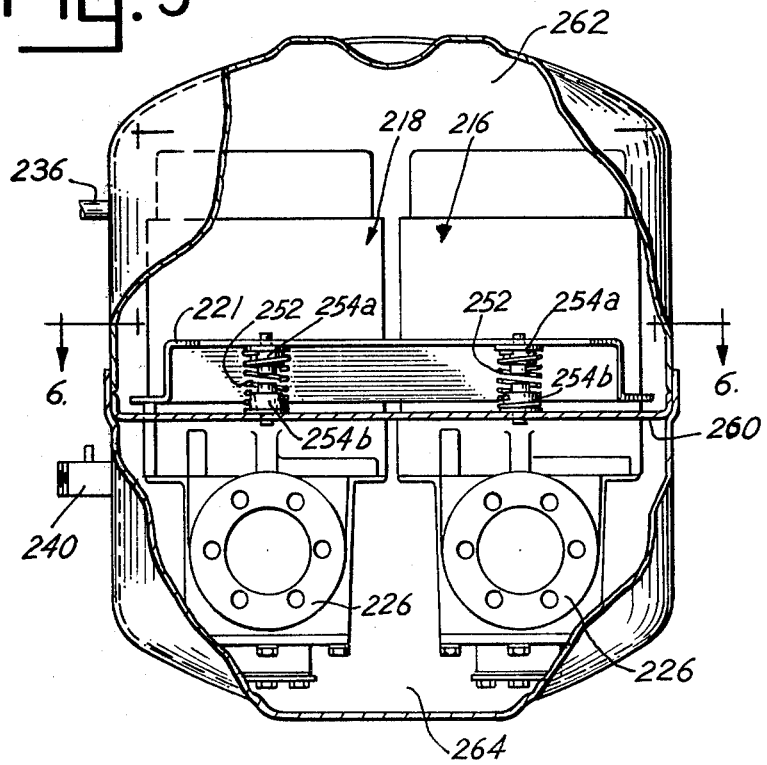
FIG. 5 is a side elevation view of FIG. 4, with part of the outer housing broken away to better show the internal construction.
Figure 6:
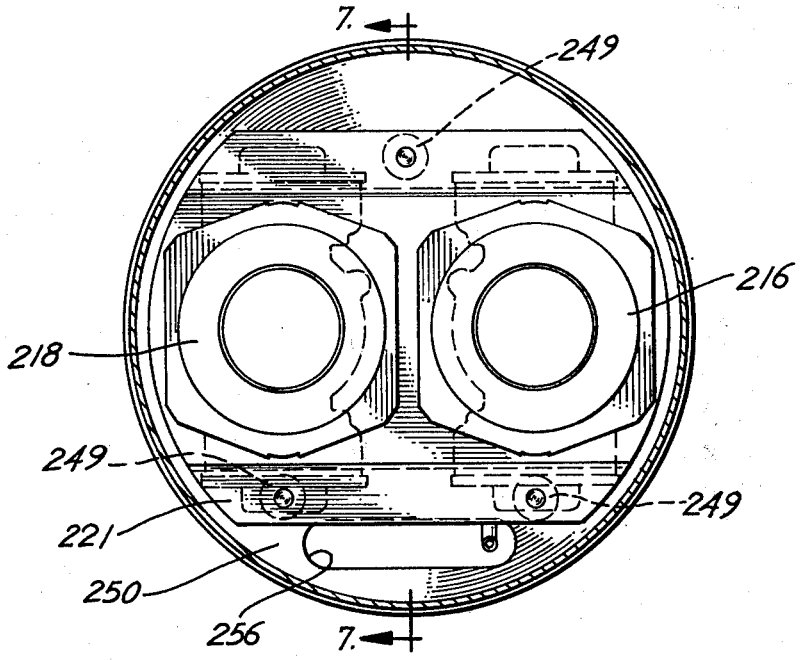
FIG. 6 is a cross-sectional view of the modified compressor assembly taken generally along the line 6—6 of FIG. 5.
Figure 7:
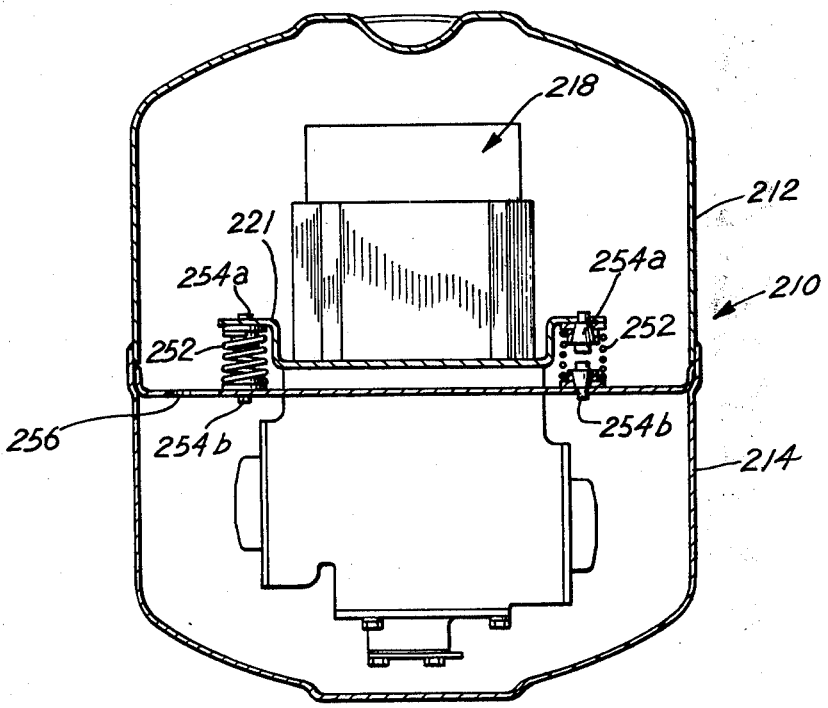
FIG. 7 is a cross-sectional view of the modified compressor assembly taken generally along line 7—7 of FIG. 6.

Referring to FIGS. 1 and 2, there is illustrated a hermetic refrigerant compressor assembly 10 embodying the present invention. The compressor 10 basically includes an outer housing or casing comprised of an upper shell 12 and a lower shell 14 hermetically sealed one to the other, as for example, by welding.

If desired, a plurality of legs (not shown) may be secured to the bottom of the exterior surface of the lower shell 14 so as to support the compressor in an upright position within a condensing unit, an air conditioning unit or other use location.

Resiliently supported within the outer housing or casing of the compressor 10 are a pair of separate compressors 16 and 18. The compressors 16 and 18 may be of like design and preferably, fabricated from high production, relatively low cost, techniques so as to reduce the cost of the overall compressor assembly needed to provide a predetermined capacity. For example, at present the cost of two five-ton compressors is less than the cost of a single ten-ton capacity compressor. Operation of one compressor would provide five tons of capacity and operation of both compressors would provide ten tons capacity. Versatility can be enhanced by utilizing compressors of separate capacity within a common housing. For example, one compressor may have three-ton capacity and the other compressor may have five-ton capacity. The resultant compressor can be controlled so as to provide either three or five ton capacity with one compressor operating and eight ton capacity with both compressors operating. In addition, it is contemplated that each compressor 16 and 18 may be a two-stage compressor. Assume each compressor 16, 18 is a five-ton two-stage compressors having two-pole, four-pole winding. Operation of one compressor at four-pole speed would provide twenty-five percent capacity. Operation of the said one compressor at two pole speed would provide fifty percent capacity. Operation of the first compressor at four pole speed and the second compressor at two pole speed would provide seventy-five percent capacity and operation of both compressors at two pole speed would provide one hundred percent of design capacity. It will be evident to those having skill in the art that this is a further technique for enhancing capacity modulation in a convenient and reliable fashion.

This invention is not concerned with the specific details of construction of the individual compressors 16 and 18, but rather with the combination of two relatively standard compressors within a single outer enclosure and unique control means within the outer casing for preventing flow of discharge gas from one compressor to the other compressor when said other compressor is in operation.

The compression mechanism 18 includes a body 20 having cylinders and pistons movable therein and an electric motor 22 operatively connected to drive shaft for driving the pistons within the cylinders in body 20. The compression mechanism 18 may be of the type disclosed in Cawley and Ellis U.S. Pat. No. 3,584,980 granted June 15, 1971 and reference may be made to said patent for more details.

The cylinders within the body 20 are each closed by an end head 26, 27. The end head 26, 27 of each cylinder communicates with a discharge gas muffler 30, 31. The mufflers 30 and 31 are interconnected by a conduit 32. Discharge gas passes from the top of the discharge gas muffler 30 via a looped conduit 34 to a single discharge gas outlet conduit 36 for communication to a refrigeration system.

Suction gas is returned to the compressor assembly 10 from the refrigerant system via the suction gas inlet 40. The suction gas entering the outer housing or casing of compressor assembly 10 from the refrigeration system fills the space between the compressors 16, 18 and the outer casing. Such suction gas passes over the electric motor 22 of compressor 18 to effectuate cooling of same and then is carried by the conduits 42 and 46 to the valve means associated with cylinder head 26 and by conduits 46 and 48 to the valve means associated with the cylinder head 27.

The compressors 16 and 18 are resiliently supported within the outer housing or casing of the compressor 10 by resilient support means 49. As best seen in FIG. 1, the resilient support means comprise a bracket 50 secured to the inner wall of the lower shell 14 of the outer housing, a flange 21 of the body 20 of compressor 18, and a resilient spring 52 disposed between the bracket 50 and flange 21. Bolt means 54 pass through an enlarged opening in flange 21 and are secured to the bracket 50. Thus, the flange 21 may move up and down freely on the bolt means 54. Similar resilient support means are provided at the right side of the compressor 18 as viewed in FIG. 2 and at the left side of the compressor 16 as viewed in FIG. 2. Plate means 56 are provided between the compressor bodies to secure them rigidly to one another.

An oil sump 60 is formed in the lower portion of the lower shell 14 to provide lubricant for lubricating the operating parts of the compressors by means of pump means within each compressor.

Control means are provided for operating the compressor assembly 10 responsive to demand in a standard air conditioning system or a heat pump system within which the compressor is employed. In operation, one compressor may be operated to provide a first capacity and then both compressors may be operated to provide a combined capacity. Assuming each compressor comprises a five-ton capacity, operating compressor 16 alone will provide five tons capacity and operating compressors 16 and 18 together will provide ten tons capacity. The device is versatile inasmuch as the compressors may be of unequal capacity. For example, compressor 16 may be of three-ton capacity and the compressor 18 may be of five-ton capacity. Operation of compressor 16 alone will provide three tons capacity and operation of both compressors 16 and 18 will provide eight tons capacity.

Another variant to capacity modulation of a refrigeration system using the improved compressor assembly of this invention is to utilize two two-speed compressors within the common housing or casing. Such arrangement would provide four stages of capacity modulation. For example, assume that each compressor 16 and 18 is a five-ton two-speed compressor. In response to a first requirement for cooling, the compressor 16 will be operated at low speed. Upon a higher demand for cooling, the compressor 16 will be operated at high speed. During this time, the compressor 18 is inoperative. Should there be an increased demand for cooling, the compressor 18 would be actuated at half speed and responsive to a further demand for cooling, the compressor 18 would be operative at full speed. Thus, it is evident there would be capacity modulation of twenty-five percent, fifty percent, seventy-five percent and one hundred percent in such system utilizing two two-stage compressors 16, 18 in a hermetic refrigerant compressor assembly 10.

When utilizing two compressors adapted to operate singly or in combination, care must be exercised to prevent refrigerant from condensing in the idle compressor during operation of the other compressor. Accumulated refrigerant liquid can create severe slugging problems, which may result in discharge valve damage and compressor failure. Thus, it is desirable to provide valve means comprising combination check and bleed valves for preventing refrigerant liquid accumulation in the cylinders of the idle compressor. One arrangement for separately housed compressors has been shown previously in Parker U.S. Pat. No. 3,126,713. An aspect of the present invention is an adaptation of an arrangement such as shown in the Parker U.S. Pat. No. 3,126,713 into a compact environment within the outer housing of the compressor assembly 10 and, more particularly, within a discharge gas muffler within the outer housing.

With reference to FIG. 2, it is noted that the components of the compressor 16 have been designated with numerals in the 100-series, equated to the comparable components of the compressor 18. The novel compact means for preventing refrigerant liquid accumulation in the cyclinders of the idle compressor are housed within the discharge gas muffler 130. With reference to FIG. 2, it is noted that the means for preventing refrigerant accumulation in the cylinders of the inoperative compressor 16 comprises a combination check valve and bleed valve 161. The combination check valve and bleed valve 161 comprises valve body 162, which is connected to the discharge gas muffler 130. The valve body 162 comprises a cylindrical housing or casing to which is connected a fitting 164, which in turn is connected to the conduit 166. Movable with the bore 167 in the valve body 162 is a piston 168. The piston 168 is biased downwardly as viewed in FIG. 3 by the spring 170, which is disposed between the top of the piston 168 and retention means 172 comprising a plate 173 retained in position by a retaining ring 174. O-ring 175 seals between plate 173 (which conforms in outer configuration with the internal configuration of bore 167) and a seat in valve body 162). The piston 168 has a cut out or recessed portion 176 which is adapted to engage and operatively actuate the tip portion 178 of the bleed valve 180. The bleed valve 180 is adapted to be biased to close the bleed opening 182 by means of the spring 184 within the bore 186 of the valve body 162. Opening 187 in the valve body communicates with the opening in the top of the discharge gas muffler 130.

Figure 3:
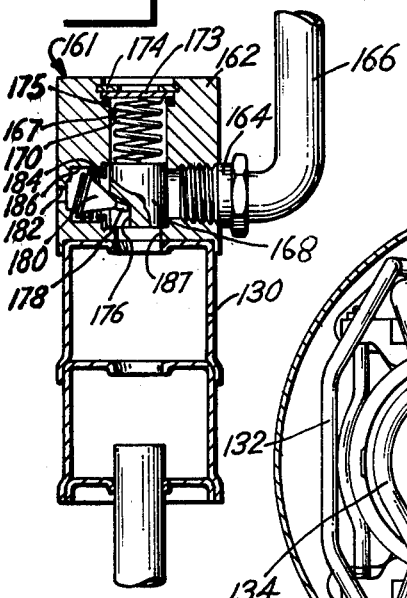
FIG. 3 is a cross-sectional view of a discharge gas muffler taken generally along the line 3—3 of FIG. 2, illustrating the means for preventing flow of discharge gas from the operative compression mechanism to the inoperative compression mechanism.

The piston 168 functions as a check valve and the element 180 functions as a bleed valve. When the compressor 16 is operative, high pressure forces the piston 168 upwardly, permitting the flow of refrigerant from the cylinder head via discharge gas muffler 130 to conduit 166 which communicates with the discharge outlet 36. The bleed valve 180 is biased by its spring 184 to close the opening 182, preventing the flow of refrigerant back to the space between the compressors. When the operation of compressor 16 is terminated, the pressure below the piston 168 is reduced and the piston 168 is biased downwardly by the spring 170 as shown in FIG. 3 to terminate the passage of fluid between the discharge gas muffler 130 and the conduit 166. The actuating stem 178 of the bleed valve 180 is actuated by the piston 168, causing the bleed valve 180 to be moved from engagement with the opening 182 and permitting the flow of refrigerant from the conduit 166 to the opening 182. In this way, damage to the compressor is prevented, for liquid accumulation in the cylinders thereof is obviated.

Referring now to FIGS. 4–7, there is shown a modified compressor assembly 210 having an outer housing or casing comprising an upper shell 212 and a lower shell 214 hermetically sealed together. A plurality of legs 215 are secured to the lower shell 214 to maintain the compressor assembly 210 in upright position for use.

The compressors 216 and 218 are essentially like the compressors 16 and 18 described above. Therefore, for convenience of illustration, some components have been omitted from FIGS. 4–7. The main features of novelty of the compressor assembly 210 which differ from the embodiment of FIGS. 1–3 are the baffle means 260 for dividing the outer housing into upper and lower compartments 262 and 264, respectively. This arrangement separates the suction gas returning to the lower compartment 264 from the hot elements of the compression mechanism in upper compartment 262 and provides for better cooling of the electric compressor drive motors, thereby providing a higher E.E.R. for the compressor assembly. The baffle means 260 comprising the plate secured on its periphery to the inner surface of the outer casing has an opening 256 therein for communicating the upper and lower compartments. Oil separated from the suction gas returning to the lower compartment 264 will flow down the sides of the lower shell and be returned to the sump in the lower portion of the lower shell 214.

The resilient means 249 for supporting the compressor mechanisms 216, 218 comprises a unitary mounting ring 221 secured to both of the compression mechanisms 216, 218 and three bolt means 254 with springs 252. The springs 252 act between the baffle means 260 and the bolt means 254. Preferably the bolt means 254 comprise studs **254*a* and 254*b* (FIG. 5) that form guides for the opposite ends of the springs 252**.

The mounting ring 221 is preferably a unitary member generally U-shaped in cross-section and including outwardly extending side flanges having openings therethrough for receiving the bolts 254. The mounting ring 221 will help to break up foam in the oil-gas mixture as may occur at start up of the compressor assembly. Also, the mounting ring 221 joins the two compression mechanisms 216, 218 and restricts their movement within the outer housing so as to prevent damage to the compression mechanisms during shipment. The compression mechanisms 216, 218 are joined by the mounting ring 221 for movement together within an opening in the baffle means 260. The opening in the baffle means 260 approximates the outer periphery of the compression mechanisms so as to help constrict radial movement of the compression mechanisms within the outer housing of compressor assembly 210.

It is to be understood that the embodiments of the invention which have been described are merely illustrative of the principles of the invention. Modifications may be made to the disclosed embodiments without departing from the true spirit and scope of the invention as defined in the claims.

What is claimed is:

1. In a refrigerant compressor, an outer casing, at least two separate compression mechanisms joined together by a mounting ring within said outer casing, discharge gas means communicating with said compression mechanisms for forwarding discharge gas from the compression mechanisms, and suction gas means communicating with the outer casing for returning suction gas to said compression mechanisms, baffle means secured within said outer casing dividing the interior of said outer casing into upper and lower compartments, said baffle means having an opening therein through which the compression mechanisms extend, said baffle means separating the suction gas and the discharge gas in the outer casing, and control means for controlling the operation of the separate compression mechanisms including means within the outer casing for preventing flow of discharge gas from one compression mechanism to the other compression mechanism when said other compression mechanism is inoperative.

2. A refrigerant compressor as in claim 1 wherein the mounting ring for said compression mechanisms is resiliently supported within said outer casing by spring means between the mounting ring and the baffle means.

3. A refrigerant compressor as in claim 2 wherein the opening in the baffle means approximates the outer periphery of the compression mechanisms so as to help constrict radial movement of the compression mechanisms within the outer casing.

4. A refrigerant compressor as in claim 1 wherein discharge gas muffler means are provided for the compression mechanisms, said means for preventing flow of discharge gas from one compression mechanism to the other compression mechanism when said other compression mechanism is inoperative being disposed within said discharge gas muffler means.

5. A refrigerant compressor as in claim 1 wherein the discharge gas muffler means comprises a discharge gas muffler for each compression mechanism, conduit means connecting each compression mechanism with an associated discharge gas muffler, and conduit means communicating with said discharge gas mufflers for porting discharge gas from the outer casing.

6. A refrigerant compressor as in claim 5 wherein the preventing means comprises valve means disposed operatively between the compression mechanisms for preventing flow of discharge gas from the operative compression mechanism to the idle compression mechanism and means for bleeding discharge pressure between the idle compression mechanism and the valve means to the suction gas means.

7. A refrigerant compressor as in claim 6 wherein the preventing means is disposed in a discharge gas muffler means.

8. A refrigerant compressor as in claim 1 wherein each compression mechanism is driven by a electric motor disposed within the outer casing.

9. A refrigerant compressor as in claim 8 wherein each compression mechanism is of equal capacity and each electric motor is a two speed motor, the control means operating one compressor at half speed or full speed and then selectively operating the second compressor at half speed or full speed so as to provide operation at selected capacities of twenty-five percent (25%), fifty percent (50%), seventy-five percent (75%), and one-hundred percent (100%).

10. A refrigerant compressor as in claim 1 wherein the compression mechanisms are of different sizes to provide for selected capacities.

11. In a refrigerant compressor, an outer casing, at least two separate compression mechanisms joined together by a mounting ring within said outer casing, discharge gas means communicating with said compression mechanisms for forwarding discharge gas from the compression mechanisms, and suction gas means communicating with the outer casing for returning suction gas to said compression mechanisms, baffle means secured within said outer casing dividing the interior of said outer casing into upper and lower compartments, said baffle means housing an opening therein through which the compression mechanisms extend, said baffle means separating the suction gas and the discharge gas in the outer casing, said mounting ring being resiliently supported within said outer casing by spring means between the mounting ring and the baffle means.

* * * * *